US005097657A

United States Patent [19]

Shekleton et al.

[11] Patent Number: 5,097,657

[45] Date of Patent: Mar. 24, 1992

[54] METHOD OF FABRICATING A FUEL INJECTOR

[75] Inventors: Jack R. Shekleton, San Diego; Steven A. Sachrison, LaJolla, both of Calif.

[73] Assignee: Sundstrand Corporation, Rockford, Ill.

[21] Appl. No.: 447,448

[22] Filed: Dec. 7, 1989

[51] Int. Cl.[5] ..... F02C 1/00

[52] U.S. Cl. ..... 60/39.02; 60/737; 60/740

[58] Field of Search ..... 60/737, 738, 740, 39.36, 60/39.02, 39.06

[56] References Cited

U.S. PATENT DOCUMENTS

| | | | |
|---|---|---|---|
| 1,032,072 | 7/1912 | Le Chatelier . | |
| 1,170,198 | 2/1916 | Sweet et al. . | |
| 1,289,812 | 12/1918 | Kinney . | |
| 1,738,082 | 12/1929 | Stark . | |
| 2,502,332 | 3/1950 | McCollum | 60/737 |
| 2,595,759 | 5/1952 | Buckland et al. . | |
| 2,922,279 | 1/1960 | Roberson et al. | 60/737 |
| 3,464,625 | 9/1969 | Carlsson . | |
| 3,471,091 | 10/1969 | Baker . | |
| 3,521,824 | 7/1970 | Wilcox . | |
| 3,748,852 | 7/1973 | Cole et al. . | |
| 3,764,071 | 10/1973 | Carlisle . | |
| 3,866,413 | 2/1975 | Sturgess | 60/742 |
| 3,942,724 | 3/1976 | Mocarski . | |
| 4,050,238 | 9/1977 | Holzapfel | 60/737 |
| 4,356,698 | 11/1982 | Chamberlain | 60/737 |
| 4,377,257 | 3/1983 | Geise . | |
| 4,516,728 | 5/1985 | Whinfrey . | |
| 4,526,322 | 7/1985 | Voorheis . | |
| 4,653,278 | 3/1987 | Vinson et al. | 60/737 |
| 4,955,201 | 9/1990 | Shekleton et al. | 60/738 |

OTHER PUBLICATIONS

Li, Wen-Hsiung et al., *Principles of Fluid Mechanics*, Addison-Wesley Publishing Co., Inc. 1964, p. 22.

*Primary Examiner*—Richard A. Bertsch
*Assistant Examiner*—Timothy S. Thorpe
*Attorney, Agent, or Firm*—Wood, Phillips, Mason, Recktenwald & VanSanten

[57] ABSTRACT

The problems of carbon build-up, poor fuel atomization, and fuel leakage in fuel injectors for turbine engines may be avoided if the fuel injector is fabricated by a method including the steps of: (a) providing a barrel (26) having an outlet end (44) adapted to be disposed in a turbine engine combustor (10), an inlet (46) adapted to be in fluid communication with the compressor of a turbine engine, an internal passage (40) extending between the inlet (46) and the outlet end (44) and a constriction (48) in the internal passage (40) between the inlet (46) and the outlet end (44) to define at least a partial venturi, (b) disposing a fuel tube (52) having a fuel injection end (54) within the internal passage (44), and (c) locating the fuel injector end (54) with respect to the constriction (48) at a position such that maximum fuel suction pressure is attained with a minimum reduction in air mass flow rate during operation of the injector.

8 Claims, 2 Drawing Sheets

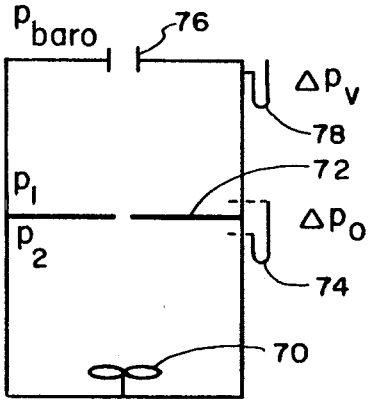
FIG. 5
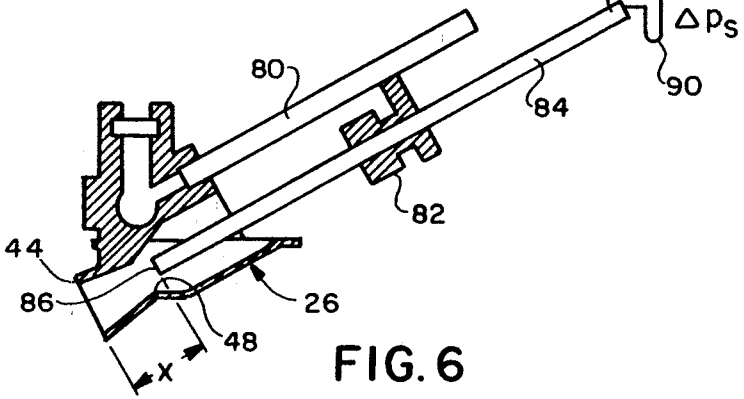
FIG. 6
FIG. 2
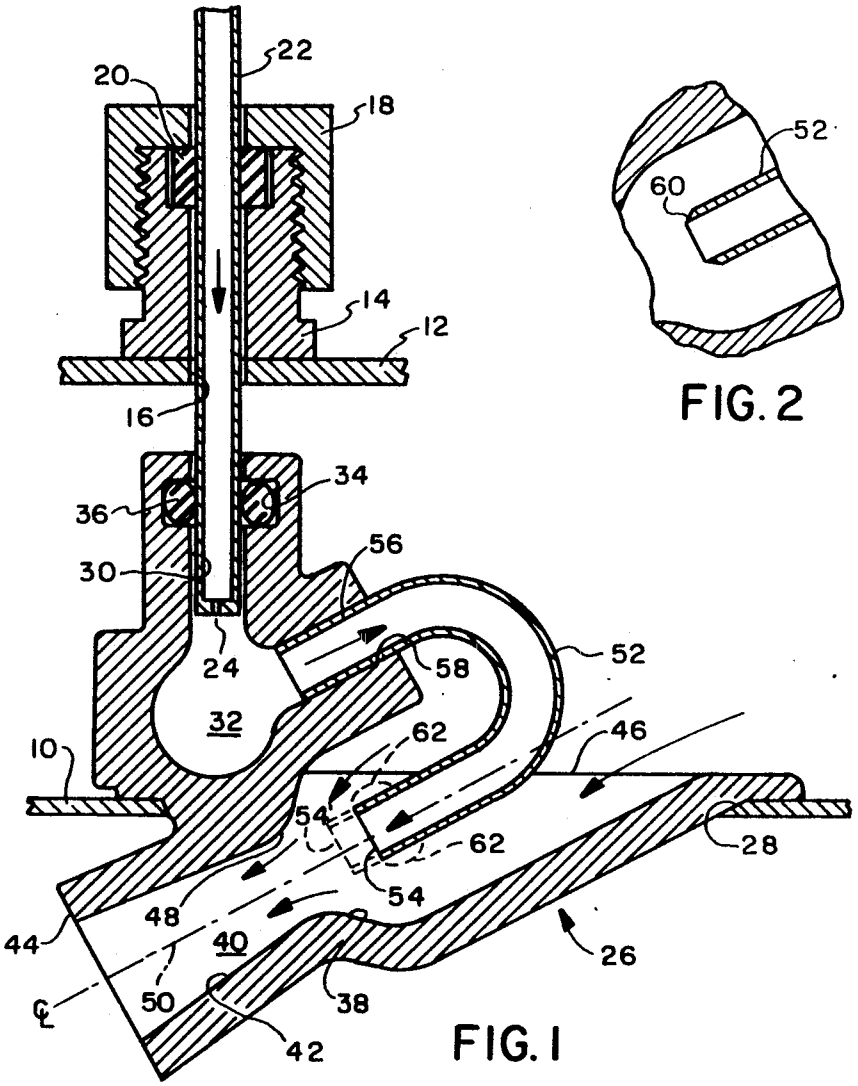
FIG. 1

AIR VELOCITY AT INJECTOR TIP VS. FUEL TUBE POSITION

FUEL SUCTION PRESSURE AND AIR MASS FLOW VS. FUEL TUBE POSITION

METHOD OF FABRICATING A FUEL INJECTOR

FIELD OF THE INVENTION

This invention relates to fuel injectors for use in turbine engines, and more particularly, to a method of fabricating a fuel injector so as to avoid or minimize one or more of the problems that may be associated therewith such as fuel leakage, carbon build-up and less than optimun fuel atomization.

BACKGROUND OF THE INVENTION

Many fuel injectors for turbine engines in use today include venturi-like constrictions in an air tube fitted about a fuel injection nozzle or the like. Fuel is delivered, via a manifold, to an atomizer fitting including the venturi. Typically, the manifold or fuel line is attached by an appropriate fitting to the case for the combustor of the engine and the atomizer fitting is brazed or welded to a combustor wall within the combustor case.

Within the fuel line, a metering orifice may be located to provide so-called "manifold head" compensation. The fuel line delivers fuel to a cavity within the atomizer fitting to one side of the venturi therein and, from the cavity a U-shaped fuel injecting tube delivers the fuel to the interior of the venturi. High velocity air from the engine compressor and directed to the space between the combustor wall and the combustor casing flows through the venturi within the atomizer fitting past the end of the U-shaped tube to atomize the fuel.

In the usual case, the fuel pressure is slightly above the air pressure between the combustor wall and the combustor casing and as a consequence, a seal must be provided between the atomizer fitting and the fuel line.

When the engine is shut-down, residual heat will soak the seal and raise the temperature substantially. Not infrequently, temperatures as high as 600° F. may be attained.

Where the seal is an O-ring seal, as is typically the case, the same deteriorates with the consequence that fuel may leak into the space between the combustor wall and the combustor casing. Fuel leakage in any event is undesirable and, where compressor bleed air is utilized in an air conditioning system for an aircraft or the like, leaking fuel can cause fuel vapors to ultimately enter the aircraft cabin via the air conditioning system.

In addition, in structures of the type mentioned before, carbon build-up may occur on the end of the U-shaped fuel tube just upstream of the venturi throat This build-up may cause hot spots or hot streaks which are undesirable and which can cause damage to the engine Further, should the carbon break loose, it may cause damaging erosion to engine parts.

The present invention is directed to avoiding the problems associated with fuel leaks and carbon build-up. In addition, it is directed to improving atomization of fuel since improved atomization will provide for better engine starting as well as lesser exhaust smoke.

SUMMARY OF THE INVENTION

It is the principal object of the invention to provide a new and improved method for fabricating a fuel injector that may be used in turbine engines It is also an object of the invention to provide an improved fuel injector. The fuel injector resulting from performance of the method is particularly intended to avoid one or more of the problems of carbon build-up or fuel leaks and to improve fuel atomization to achieve the benefits associated therewith An exemplary embodiment of the invention contemplates a method of fabricating a fuel injector for use in a turbine engine and which includes the steps of a) providing a barrel having an outlet end adapted to be disposed in a turbine engine combustor, an air inlet adapted to be in fluid communication with the compressor of a turbine engine, an internal passage extending between the inlet and the outlet end and a constriction in the internal passage between the inlet and the outlet ends defining at least a partial venturi; b) disposing a fuel tube having a fuel injection end within the internal passage; and c) locating the fuel injection end with respect to the constriction at a position such that substantially maximum fuel suction pressure with a minimum reduction in air mass flow rate is obtained during operation of the injector or slightly away from such position on the side thereof remote from the constriction.

According to one embodiment of the invention, there is further included the step of chamferring the fuel injection end of the tube while according to another and highly preferred embodiment, there is included the step of forming the injection end as a blunt end.

Stated another way, the invention contemplates a method including a) providing a barrel having an outlet end adapted to be disposed in a turbine engine combustor, an air inlet adapted to be in fluid communication with the compressor of a turbine engine, an internal passage extending between the inlet and the outlet end and a constriction in the internal passage between the inlet and the outlet ends defined at least a partial venturi; b) disposing a fuel tube having a fuel injection end with the internal passage; and c) locating the fuel injection end with respect to the constriction at a position such that air velocity at the fuel injection end is maximized or slightly away from such position on the side of such position remote from the constriction.

According to the invention, the constriction is defined at least by a converging section on the internal passage. In one embodiment of the invention, the constriction is defined first by a converging section of the internal passage and then by a following, diverging section of the passage which extends to the outlet end.

The invention also contemplates a fuel injector for a turbine which includes an atomizer fitting with a venturi opening to the exterior of the fitting at opposite ends thereof. One of the ends is adapted to be disposed within a combustor and the other end is adapted to be located between the wall of the combustor and a combustor case. A cavity is disposed in the atomizer fitting and is located to one side of the venturi. An outlet from the cavity is spaced from and is generally parallel to the venturi and adjacent the other end thereof. An inlet to the cavity is adapted to be located between the combustor wall and a combustor case and an O-ring receiving groove is associated with the inlet. An O-ring is located in the groove and a fuel tube is adapted to extend through the combustion case and into the inlet in sealed relation to the O-ring. A U-shaped tube having one end in the outlet and another end within the venturi is provided. The end within the venturi is so located therein that fuel suction pressure will be substantially at a maximum while any reduction in air mass flow rate through the venturi will be relatively small.

As a result of the foregoing method and fuel injector construction, one or more of the following advantages is obtained:

a) fuel leakage is minimized;

b) carbon build-up is minimized; and c) atomization of fuel is enhanced.

Other objects and advantages will become apparent from the following specification taken in connection with the accompanying drawings.

DESCRIPTION OF THE DRAWINGS

FIG. 1 is a sectional view of a fuel injector of the type with which the present invention may be implemented;

FIG. 2 is a fragmentary sectional view of a slightly modified form of the fuel injector;

FIG. 5 is a somewhat schematic view of a test apparatus for determining various values that are utilized in the performance of the method of the invention; and FIG. 6 is an illustration of a test apparatus that may be utilized in determining the optimal location of a fuel tube in practicing the invention.

DESCRIPTION OF THE PREFERRED EMBODIMENTS

Figure 4:
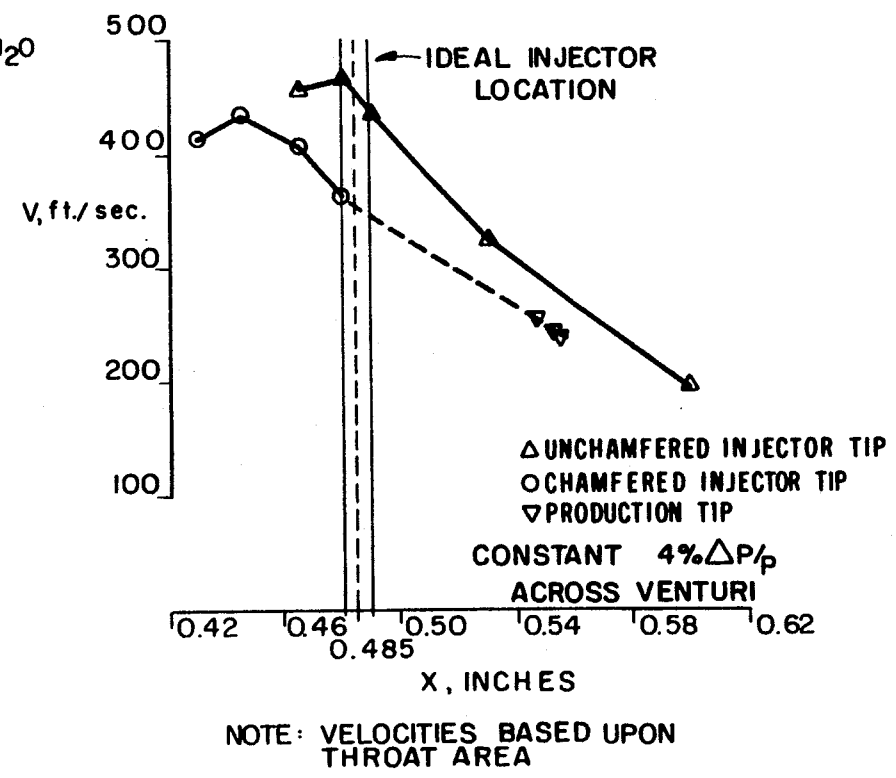
FIG. 4 is a graph of actual test results plotting the velocity of the air in feet per second at the injector tip vs. the fuel tube position within the venturi.

One form of a fuel injector for a turbine engine with which the invention may be practiced is illustrated in FIG. 1. The solid line configuration is conventional while the dotted line positioning of a fuel injection tube, as will be described, is accomplished according to the invention.

In any event, a turbine combustor wall is shown at 10 and the same is surrounded by a combustor casing 12 as is well known. The space between the wall 10 and the casing 12 will be in fluid communication with the compressor section of a turbine engine as is well known. The threaded male end 14 of a fitting is brazed or welded to the exterior of the casing 12 about an aperture 16 therein. The fitting includes a female part 18 which is internally threaded and which may be disposed on the male element 14 and threaded thereon to compress a seal 20 against the exterior wall of a manifold fuel line 22.

The fuel line 22 extends through the opening 16 into the space between the combustor wall 10 and the casing 12 and terminates in a fuel metering orifice 24. The orifice 24 is intended to provide so-called "manifold head" compensation where the invention is employed with a turbine engine that is intended to operate at extremely high altitudes.

An atomizer fitting, generally designated 26, is disposed in an opening 28 in the combustor wall 10 and welded or brazed thereto. The fitting 26 includes a fuel inlet 30 which extends to a cavity 32. The fuel manifold line 22 extends almost to the cavity 32 via the inlet 30.

Associated with the inlet 30 is a radially inwardly opening peripheral groove 34 which in turn receives an O-ring seal 36 to seal against the exterior of the manifold fuel line 22.

The fitting 26 also includes a venturi defined by a converging section 38 of an internal passage 40 which merges into a diverging section 42 which in turn extends to an outlet end 44.

An air inlet 46 between the combustor wall 10 and the casing 12 is in fluid communication with the passage 40, and specifically, the converging section 38.

As is well known, the area between the sections 38 and 40, shown at 48, is a constriction and is generally termed the venturi throat.

The center line or axis of the passage 40 is shown at 50 and it will be seen that a U-shaped fuel injection tube 52 has one end 54 located on the axis 50 just upstream of the throat 48. The opposite end 56 of the tube 52 is disposed in a fuel outlet 58 from the cavity 32 and typically will be brazed in place with the end 54 in a desired location with respect to the throat 48.

As noted above, the solid line illustration in FIG. 1 illustrates a prior art configuration known as a T32A-type of injector commercially utilized by the assignee of the instant application. In such an injector, the distance from the end 54 of the tube 52 to the outlet end 44 of the fitting 26 would be 0.55 inches However, according to the invention, the end 54 is located more closely to the throat 48 as shown by the dotted line indication 54'. According to the invention, the distance between the outlet end 44 of the fitting 26 and the end 54' of the tube 52 is 0.485 inches.

In some instances, the end 54 or 54' of the tube 52 is chamfered on its exterior surface. Such a chamfer is shown at 60 in FIG. 2.

Returning to FIG. 1, when the tube 52 is in the solid line or prior art position, there is a tendency for carbon build-up to occur on the end 54 of the tube as illustrated by the dotted line 62. Avoiding this carbon build-up is one of the advantages that is obtained by advancing the end 54 towards the throat 48 as mentioned previously.

Another advantage accrues from the fact that as the end 54 is advanced towards the throat, the cross-sectional area through which air may flow is progressively reduced meaning that the air velocity at the end 54 or 54' is increased. The increased air velocity in turn means improved atomization of fuel exiting the end 54'.

The increased velocity of air passing the end 54' also increases the fuel suction pressure which in turn means that the pressure of fuel applied to the fuel line 22 may be reduced. This in turn reduces the possibility of leakage at the O-ring 36 and thereby avoids the problem of fuel vapors finding their way into bleed air and air conditioning systems using the same.

Figure 3:
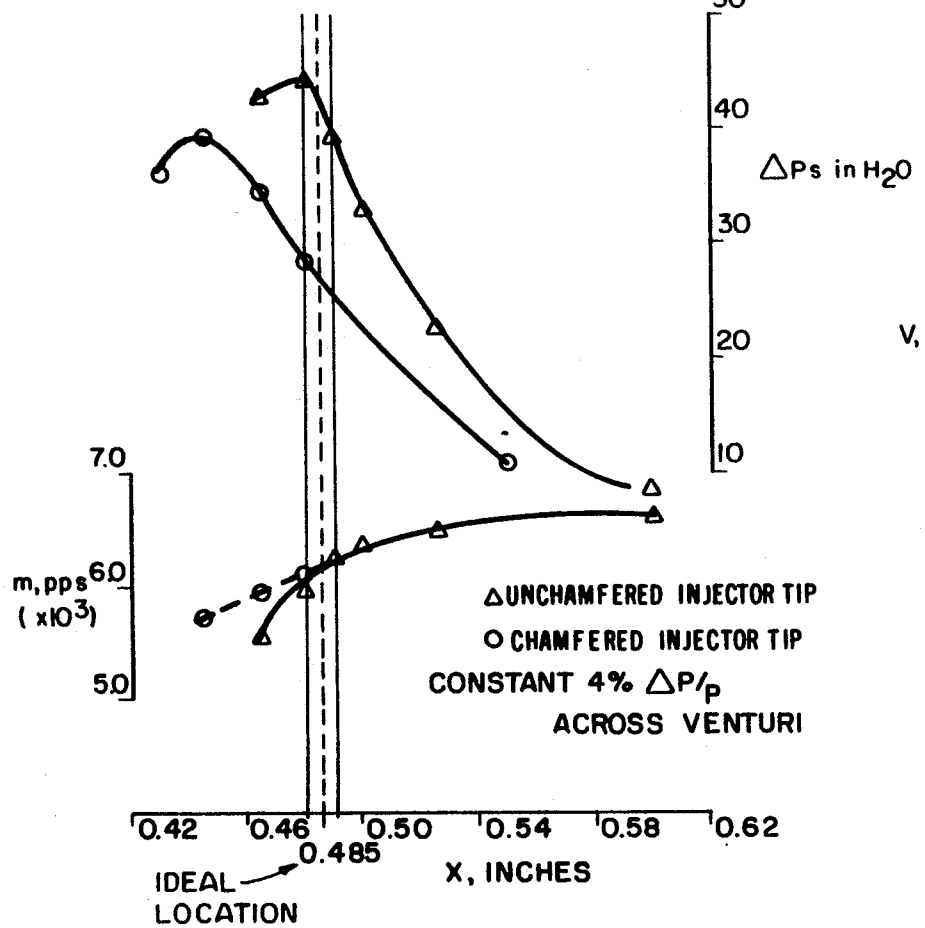
FIG. 3 is a graph of actual test results plotting fuel suction pressure in inches of water and air mass flow rate in lbs. per second against the position of the fuel tube within a venturi in the fuel injector.

According to the invention, the optimum distance between the end 54 of the fuel tube and the outlet end 44 is a function of fuel suction pressure, air mass flow rate, and/or air velocity at the injector tip. FIG. 3 plots fuel suction pressure in inches of water on the one hand, and air mass flow rate in lbs. per second, on the other hand vs. the fuel tube position. As can be seen, a peak fuel suction pressure is attained at a spacing of 0.48 inches. At a spacing of 0.49 inches, the mass flow rate of air is beginning to fall off, falling off perhaps 10%. An optimum spacing may be found between the maximum suction pressure location and the point at which air mass flow rate begins to fall off, in this case, at 0.485 inches, whereat a minimal reduction in mass flow rate of about 5% or less occurs.

Viewed another way, one may determine the maximum fuel suction pressure as well as the general area at which air mass flow rate begins to fall off and simply move the end 54 slightly away from the throat 48 to assure that there is no meaningful interference with the mass flow of air through the venturi.

This approach may work well where air velocity at the end 54 of the injection tube 52 is measured. As seen in FIG. 4, for an unchamfered injector tip, air velocity is maximized at 0.480 inches. By backing off away from the throat approximately five thousandths of an inch, the same sort of result as is shown in FIG. 3 is obtained.

In both FIGS. 3 and 4, other data is illustrated for chamfered injector tips. Obviously, the data is somewhat different because the presence of the chamfer 60 affects the cross-sectional area through which air may flow. Because of the chamfer, the end 54 of the tube 52 may be moved more closely to the throat 48 before the same cross-sectional flow area is obtained.

FIGS. 5 and 6 illustrate means by which data to enable the foregoing determinations may be obtained FIG. 5 schematically illustrates a so-called cold flow test bench. A fan 70 serves to provide air at a pressure P2 to one side of a fixed orifice 72 and a U-tube manometer 74 can provide a means of determining the pressure drop across the orifice 72 for calibration purposes. A venturi is schematically illustrated at 76 and an open ended U-tube manometer 78 provides an indication of the pressure drop across the orifice. For the data illustrated in FIGS. 3 and 4, a constant 4% pressure drop across the orifice was employed.

FIG. 6 illustrates a means by which the fuel suction pressure may be ascertained. The fitting 26 to be tested is suitably secured by any desired means and a rigid rod 80 secured thereto as, for example, by insertion within the fuel outlet opening 58. A chuck is suspended from the rod 80 and a straight length of tube 84 having the same outer diameter and wall thickness as the tube 52 supported by the chuck 82.

An end 86 of the tube 84 simulates the end 54 and is moved toward or away from the throat 48 as desired The opposite end of the tube, shown at 88, is connected to a U-tube manometer 90 from which the suction pressure may be determined as air from the fan 70 is flowed through the fitting 26.

Thus, by loosening the chuck 82 and varying the position of the tube 84 relative to the end 44 of the fitting 26 while directing air through the same, fuel suction pressure can be determined.

It is to be particularly kept in mind that the invention is not limited to situations wherein a full venturi is utilized. That is to say, part or all of the diverging section 42 may be eliminated Such elimination may be desirable in those instances where size or volume constraints suggest that the size of the injectors be minimized and/or where the fuel is actually wetting part of the diverging section 42 during operation of the injector.

In summary, a number of benefits are achieved through use of the invention. By locating the end 54 or 54' of the injection tube more closely to the throat, 48 or constriction, a higher air velocity past the fuel injection tip may be achieved with only minimal reduction in air mass flow rate. This increased velocity which, in the form of the invention illustrated herein, represents approximately a 75% or greater increase in velocity, and enhances fuel atomization In addition, it increases the fuel suction pressure meaning that the total pressure differential between the manifold (not shown) and the end 54 may be reduced, thereby reducing the possibility of leakage at the O-ring 36. In addition, the higher air velocities appear to prevent carbon build-up at the end 54.

We claim:

1. A method of fabricating a fuel injector for use in a turbine engine and including the steps of: (a) providing a barrel having an outlet end adapted to be disposed in a turbine engine combustor, an air inlet adapted to be in fluid communication with the compressor of a turbine engine, an internal passage extending between said inlet and said outlet end and a constriction in said internal passage between said inlet and said outlet end to define at least a partial venturi; (b) disposing a fuel tube having a fuel injection and within said internal passage; and (c) locating said fuel injection end with respect to said constriction at a position such that maximum fuel suction pressure with minimum reduction in air mass flow rate is obtained during operation of said injector by steps including flowing air through the internal passage and measuring suction pressure on said tube.

2. The method of claim 1 wherein step (c) includes or is followed by the step of locating said fuel injection end slightly away from a theoretically optimal position in the direction away from said constriction to assure minimum impediment to the mass flow of air through said internal passage.

3. The method of claim 1 including the step of chamferring said fuel injection end.

4. The method of claim 1 including the step of forming said fuel injection end as a blunt end.

5. A method of fabricating a fuel injector for use in a turbine engine and including the steps of (a) providing a barrel having an outlet end adapted to be disposed in a turbine engine combustor, an air inlet adapted to be in fluid communication with the compressor of a turbine engine, an internal passage extending between said inlet and said outlet end and a constriction in said internal passage between said inlet and said outlet end to define at least a partial venturi; (b) disposing a fuel tube having a fuel injection end within said internal passage; and (c) locating said fuel injection end with respect to said constriction at a position such that air velocity at said fuel injection end is maximized or slightly away from said position on the side of said position remote from said constriction, including flowing air through said passage and measuring the pressure drop across said passage.

6. The method of claim 1 wherein said constriction is defined by a converging section of said internal passage.

7. The method of claim 5 wherein said constriction is defined by a converging section of said internal passage followed by a diverging section of said passage which extends to said outlet end.

8. A fuel injector for a turbine engine comprising:

an atomizer fitting including a venturi having a longitudinal axis and opening to the exterior of the fitting at opposite ends thereof, one of said ends being adapted to be disposed within a combustor, the other end being adapted to be located between a wall of the combustor and a combustor case;

a cavity in said atomizer fitting located to one side of said venturi;

an outlet form said cavity spaced from and generally parallel to said venturi and adjacent said other end thereof;

an inlet to said cavity and adapted to be located between the combustor wall and a combustor case;

an O-ring receiving groove associated with said inlet;

an O-ring in said groove;

a fuel tube adapted to extend thru the combustion case and into said inlet in sealed relation to said O-ring; and a U-shaped tube having one end in said outlet and another end within said venturi, said another end being so located within said venturi that fuel suction pressure will be substantially at a maximum while any reduction in air mass flow rate thru said venturi will be minimal, said U-shaped tube having parallel legs with one of said legs terminating in said one end and the other of said legs terminating in said other end, one of said legs being coaxial with said venturi longitudinal axis.

* * * * *